US005464217A

United States Patent [19]

Shenoha et al.

[11] Patent Number: 5,464,217

[45] Date of Patent: Nov. 7, 1995

[54] OPEN RAIL METAL WOOD GOLF CLUBHEAD

[75] Inventors: James L. Shenoha, Lockport; Carl E. Scheie, Libertyville, both of Ill.

[73] Assignee: Wilson Sporting Goods Co., Chicago, Ill.

[21] Appl. No.: 171,212

[22] Filed: Dec. 21, 1993

[51] Int. Cl.[6] ..... A63B 53/04

[52] U.S. Cl. ..... 273/169

[58] Field of Search ..... 273/169, 170, 273/171, 167 E, 167 F, 167 H

[56] References Cited

U.S. PATENT DOCUMENTS

| | | | |
|---|---|---|---|
| D. 115,216 | 6/1939 | Newsome | D21/214 |
| D. 137,813 | 5/1944 | Newsome | D21/214 |
| D. 137,814 | 5/1944 | Newsome | D21/214 |
| D. 137,815 | 5/1944 | Newsome | D21/214 |
| D. 141,307 | 5/1945 | Newsome | D21/214 |
| D. 141,769 | 7/1945 | Newsome | D21/214 |
| D. 149,156 | 3/1948 | Weatherington | D21/214 |
| D. 239,964 | 5/1976 | Wilson | D21/214 |
| D. 243,706 | 3/1977 | Hall | D21/214 |
| D. 285,231 | 8/1986 | Solomon | D21/214 |
| 1,541,126 | 6/1925 | Dunn | 273/77 R |
| 1,616,920 | 2/1927 | Pederson | 273/169 X |
| 1,916,792 | 7/1933 | Hadden | 273/77 R |
| 2,201,638 | 5/1940 | Theibault | 273/77 R |
| 3,810,631 | 5/1974 | Braly | 273/167 A |
| 3,976,299 | 8/1976 | Lawrence | 273/171 |
| 3,997,170 | 12/1976 | Goldberg | 273/167 E X |
| 4,065,133 | 12/1977 | Gordos | 273/167 E |
| 4,444,392 | 4/1984 | Duclos | 273/169 X |
| 4,555,112 | 11/1985 | Masghati | 273/77 A |
| 4,618,149 | 10/1986 | Maxel | 273/79 |
| 4,653,756 | 3/1987 | Sato | 273/169 X |
| 4,850,593 | 7/1989 | Nelson | 273/167 E |
| 5,120,062 | 6/1992 | Sheie et al. | 273/167 F |
| 5,203,565 | 4/1993 | Murray | 273/169 X |

FOREIGN PATENT DOCUMENTS

| | | | |
|---|---|---|---|
| 0574217 | 12/1993 | European Pat. Off. . | |
| 7279 | of 1902 | United Kingdom | 273/169 |
| 2126906 | 4/1994 | United Kingdom . | |

OTHER PUBLICATIONS

Bullet advertisement in Golf Digest publication date not known.

Bullet advertisement in Golfweek, Oct. 30, 1993.

*Primary Examiner*—William H. Grieb

[57] ABSTRACT

A golf clubhead includes a front face, a top crown, and a plurality of rails which extend rearwardly from the face and downwardly from the crown. The open structure provided by the rails permit weight to be distributed high in the toe portion and low in the heel portion of the clubhead.

17 Claims, 8 Drawing Sheets

OPEN RAIL METAL WOOD GOLF CLUBHEAD

BACKGROUND

This invention relates to golf clubheads of the metal wood type. More particularly, the invention relates to a golf clubhead which is characterized by an open body structure which is provided by a plurality of spaced-apart rails.

Most metal wood clubheads have a hollow construction. Such clubheads include a hollow body formed by investment casting and a soleplate which is welded to the bottom of the body. The hollow interior of the clubhead may be filled with foamed resin. Almost the entire mass of the clubhead material is used to form the shape of the head. As a result, little or no mass is available to be distributed in a way which would enhance performance. Further, the hollow construction has inherent manufacturing problems. For example, in most cases a hollow clubhead is formed from two parts which must be joined by welding or adhesives.

Some metal wood clubheads have been formed integrally, and some of those clubheads have included various shaped ribs and airfoils. However, such clubheads have generally not distributed the weight of the clubhead in a manner which optimizes performance.

SUMMARY OF THE INVENTION

The invention provides an integrally formed open rail metal wood. The clubhead includes a striking face and top crown of a traditional head to provide a traditional appearance. However, the side skirt and sole are eliminated. They are replaced with an open structure which has vertical rails which define the outline of the bottom and side of a clubhead. The open structure permits weight to be added selectively at predetermined locations of the clubhead to enhance performance. If desired, weight can also be removed from the top surface of the crown by forming grooves therein.

DESCRIPTION OF THE DRAWING

The invention will be explained in conjunction with an illustrative embodiment shown in the accompanying drawing, in which —

DESCRIPTION OF SPECIFIC EMBODIMENT

Figure 1:
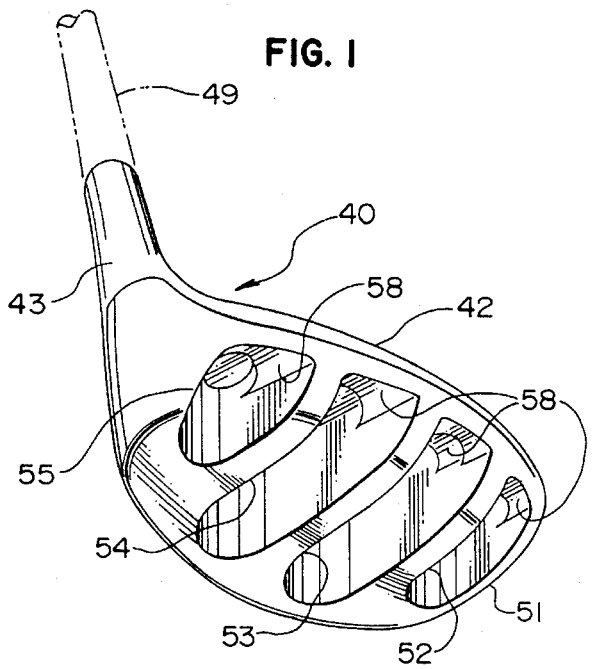
FIG. 1 is a bottom perspective view of a clubhead formed in accordance with the invention.
Figure 2:
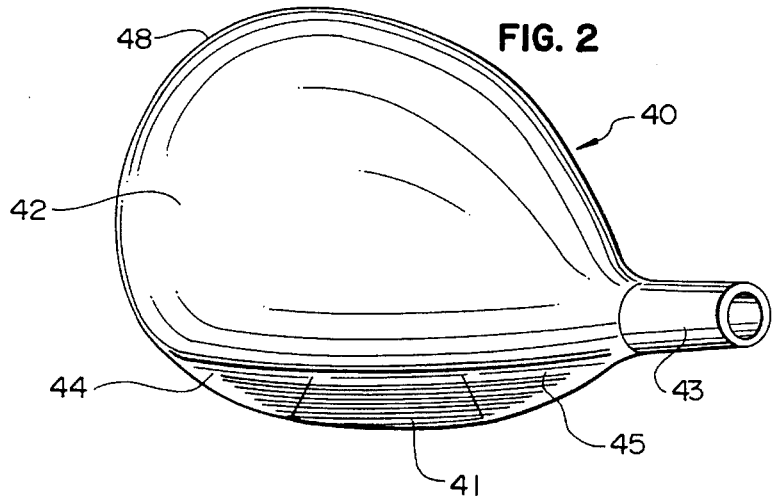
FIG. 2 is a top plan view of the clubhead.
Figure 4:
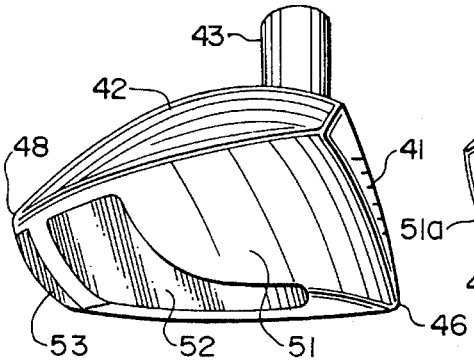
FIG. 4 is a toe end view of the clubhead.
Figure 3:
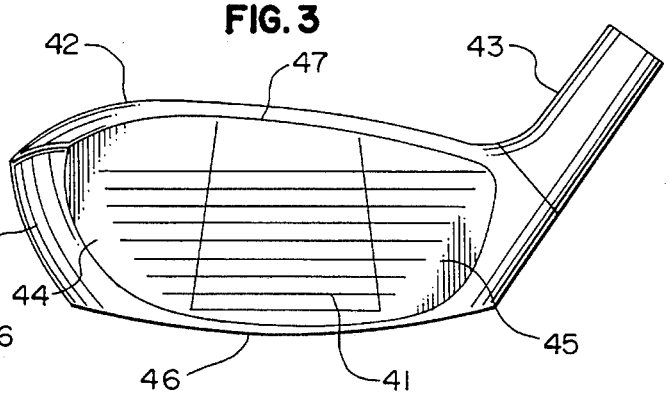
FIG. 3 is a front elevational view of the clubhead.

Referring to FIGS. 1–9, a metal clubhead 40 includes a front striking face 41, a top crown 42, and a hosel 43. The face includes a toe portion 44, a heel portion 45, a curved bottom or sole edge 46, and a top edge 47. The crown extends rearwardly from the top edge of the face and is dome-shaped or convex. The periphery of the crown is defined by a somewhat circular side edge 48. The hosel 43 extends angularly upwardly from the merger of the heel portions of the face and crown and is used to attach a shaft 49 (FIG. 1).

Figure 5:
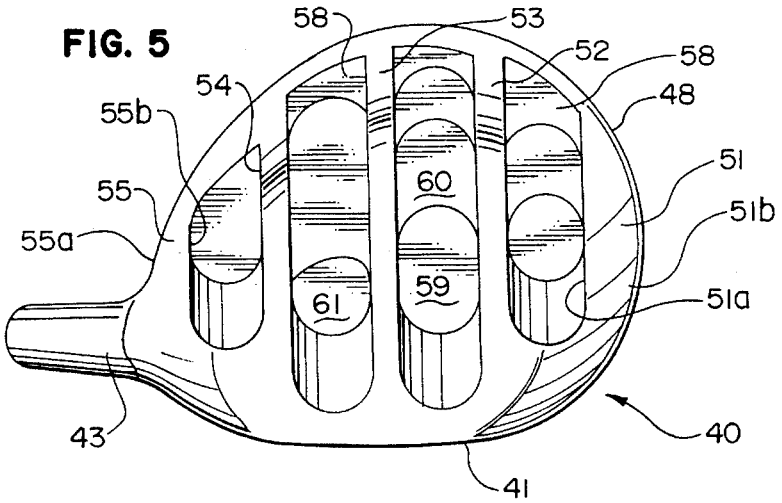
FIG. 5 is a bottom plan view of the clubhead.
Figure 6:
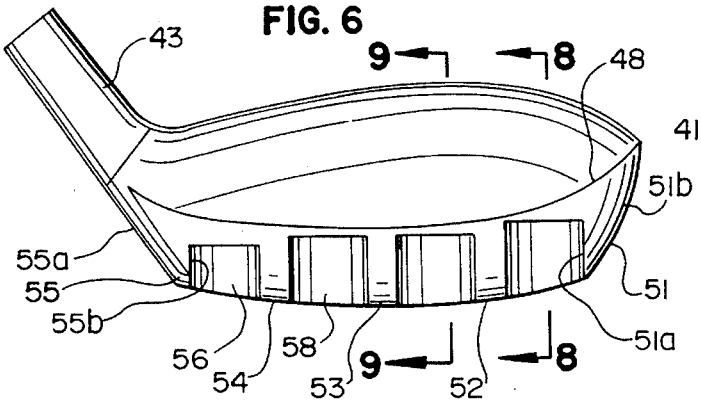
FIG. 6 is a rear elevational view of the clubhead.
Figure 7:
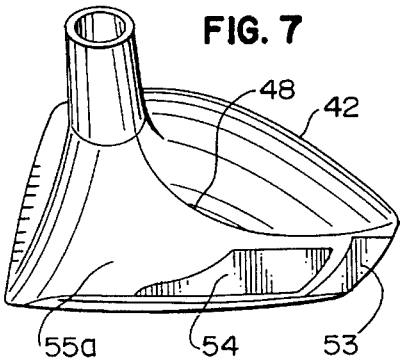
FIG. 7 is a heel end view of the clubhead.

As can be seen in FIGS. 1, 5, and 6, the bottom of the clubhead is substantially open, and a plurality of rails 51, 52, 53, 54, and 55 extend rearwardly from the back surface 56 of the face 41 (FIG. 8) and downwardly from the bottom surface 57 of the crown 42. Adjacent rails are separated by channels or slots 58. The inside rails 52–54 have substantially planar side surfaces which are substantially parallel to each other and substantially perpendicular to a plane which is tangent to the center of the face 41. The surfaces of the rails are preferably not exactly parallel and will generally include draft angles to facilitate casting. The face 41 is not necessarily flat and may be provided with conventional bulge and roll curvatures.

The rail 51 includes a flat inside side surface **51*a* and a curved outside side surface 51*b* which extends downwardly from the edge 48** of the crown and forms the toe end of the clubhead.

The rail 55 includes a flat inside side surface **55*b* and a curved outside surface 55*a* which extends downwardly from the edge 48** of the crown and forms the heel end of the clubhead.

Figure 9:
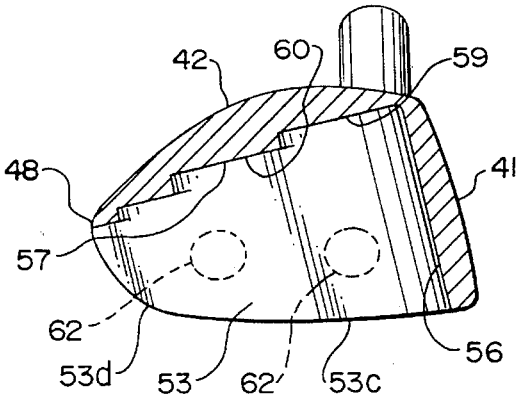
FIG. 9 is a sectional view taken along the line 9—9 of FIG. 6.
Figure 10:
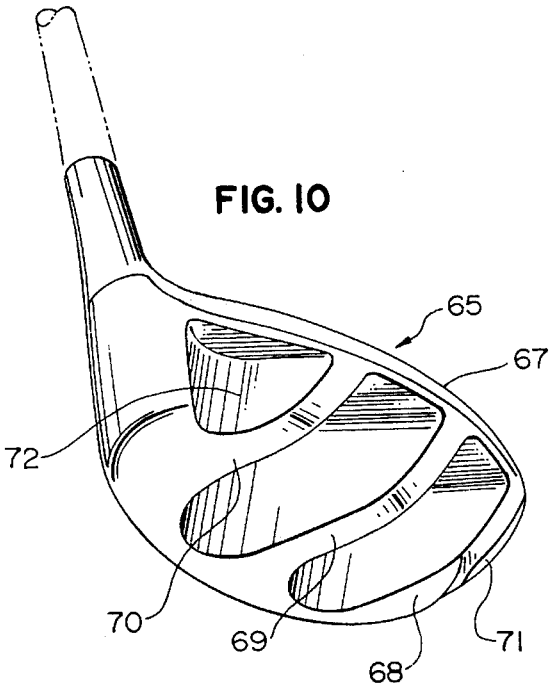
FIG. 10 is a bottom perspective view of another embodiment of a clubhead.
Figure 11:
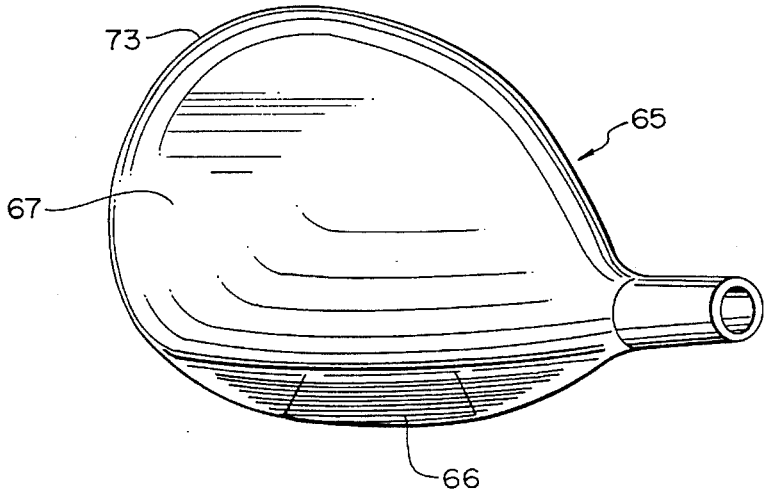
FIG. 11 is a top plan view of the clubhead of FIG. 10.
Figure 12:
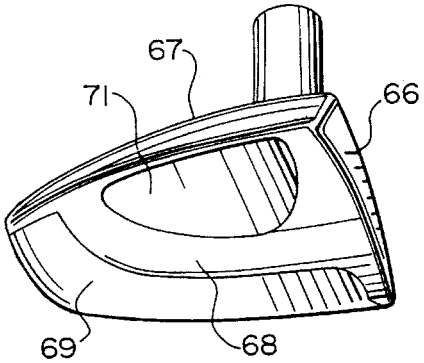
FIG. 12 is a toe end view of the clubhead.
Figure 13:
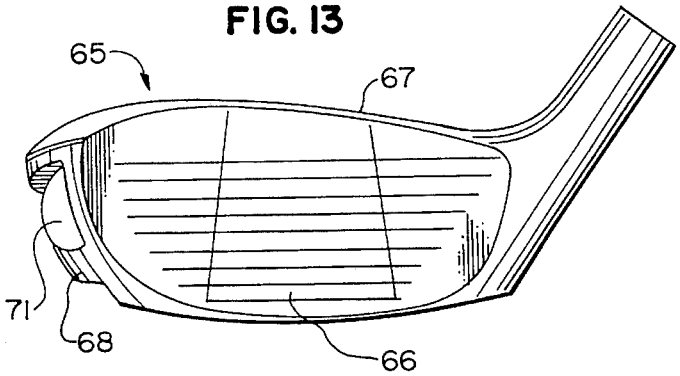
FIG. 13 is a front elevational view of the clubhead.

Referring to FIG. 9, the rail 53 includes a bottom surface 53*c* which extends rearwardly from the sole edge of the face 41 and a rear surface 53*d* which curves upwardly from the bottom surface 53*c* to the side edge 48 of the crown 42. The other rails include similar bottom and rear surfaces, and the bottom surfaces of the rails cooperate to form an interrupted bottom surface of the clubhead for soling the clubhead on the ground. Referring to FIG. 6, the interrupted bottom surface curves from the toe to the heel. Accordingly, even though the bottom of the clubhead is formed by the open rail structure, the clubhead can be soled on the ground during address in the conventional manner. Further, when viewed from the top during address (FIG. 2), the clubhead presents a conventional appearance.

The clubhead can be formed integrally in one operation, thereby eliminating the necessity for joining parts. The clubhead can be formed by investment casting, die casting, or other suitable techniques.

The open rail structure provides a clubhead with a high center of gravity and permits the mass or weight of the clubhead to be distributed as desired to optimize the performance of the clubhead. For example, in accordance with the teachings of U.S. Pat. Nos. 4,555,112 and 5,120,062, the weight of the clubhead can be distributed high in the toe area and low in the heel area. This can easily be accomplished by varying thickness of the face between the rails. The shape, thickness, and position of the rails 51–55 can also be adjusted as desired.

Figure 8:
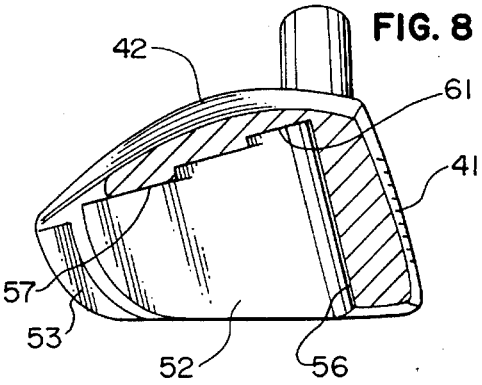
FIG. 8 is a sectional view taken along the line 8—8 of FIG. 6.

Referring to FIGS. 5, 8, and 9, weight can easily be removed from selected portions of the crown 42 by forming upwardly extending bores 59, 60, 61, etc. Weight can be removed from one or more rails by forming openings 62 therein. The bores and openings can be formed during the casting operation or can be subsequently formed by drilling, boring, or the like. The weight removed by the bores and openings can be added to other areas of the clubhead.

Referring to FIGS. 5, 8, and 9, the thickness of the face 41 between the toe rail 51 and the rail 52 and between the heel rail 55 and the rail 54 is greater than the thickness of the face between the rails 52, 53, and 54. Accordingly, more weight is positioned in the toe and heel areas of the club. If desired, the additional weight, i.e., greater thickness, in the toe area of the face can be located near the crown, and the additional weight in the heel area can be located near the sole.

FIGS. 10–18 illustrate a clubhead 65 which includes a face 66, a crown 67, and three rails 68, 69, and 70. The clubhead has a traditional look when viewed at address (FIG. 11), but the side rails 68 and 70 are spaced inwardly from the toe and heel, respectively, to provide open areas 71 and 72 below the edge 73 of the crown.

Figure 17:
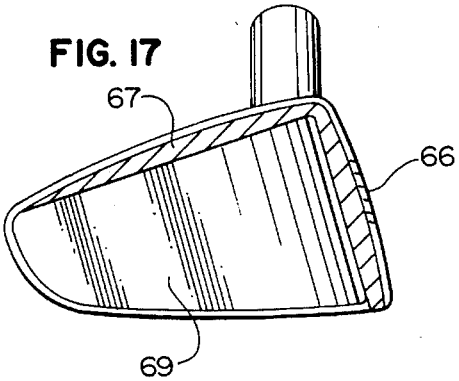
FIG. 17 is a sectional view taken along the line 17—17 of FIG. 15.
Figure 18:
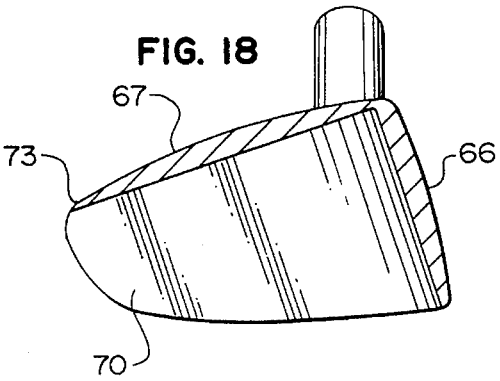
FIG. 18 is a sectional view taken along the line 18—18 of FIG. 15.
Figure 19:
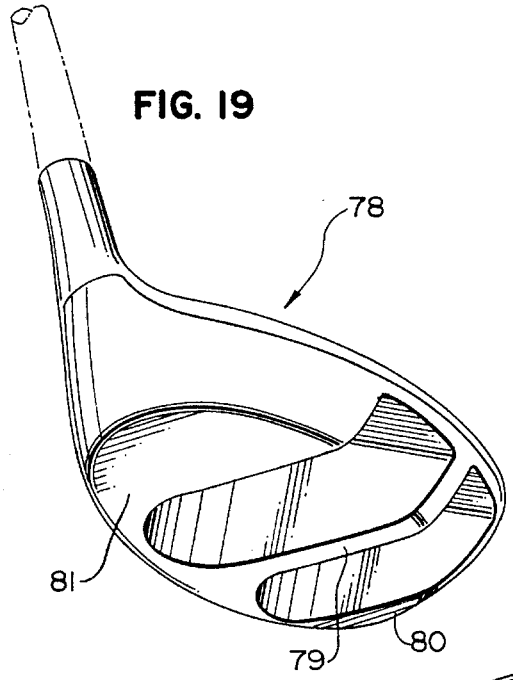
FIG. 19 is a bottom perspective view of still another embodiment of a clubhead.
Figure 20:
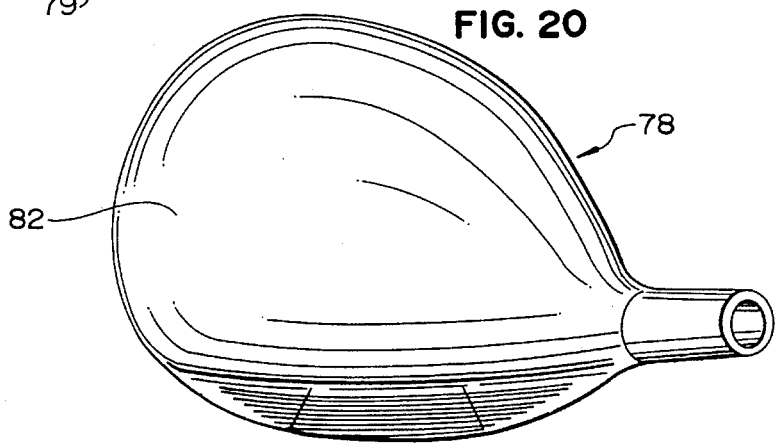
FIG. 20 is a top plan view of the clubhead of FIG. 19.
Figure 21:
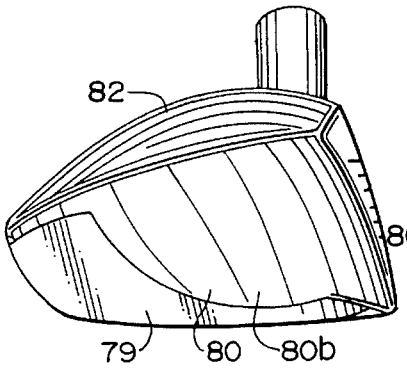
FIG. 21 is a toe end view of the clubhead.

The spaces or channels 74 between the rails 68–70 are wider than the channels 58 between the rails 51–55 of the clubhead 40 in FIGS. 1–9, and the rails 68–70 are thicker than the rails 52–54. Referring to FIGS. 17 and 18, each of the rails includes a relatively flat bottom or sole surface which extends rearwardly from the sole edge of the face for supporting the clubhead at address and a curved rear surface which extends upwardly to the crown.

Figure 14:
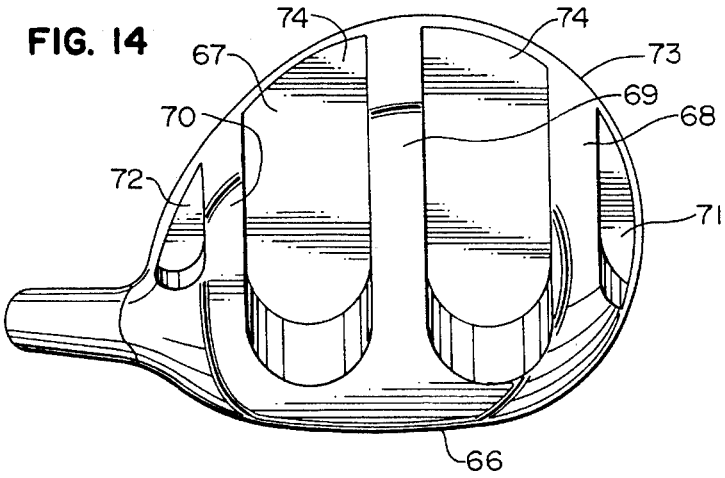
FIG. 14 is a bottom plan view of the clubhead.
Figure 15:
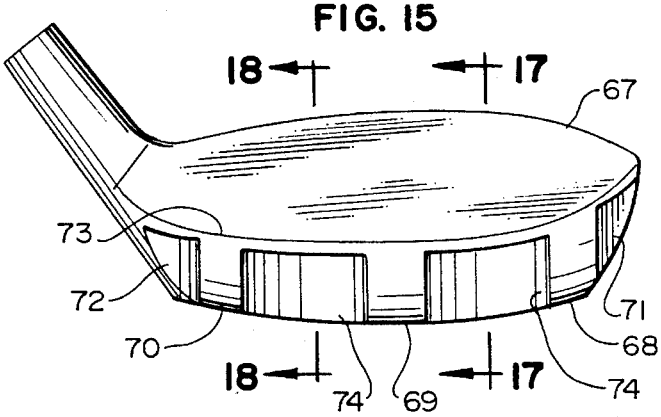
FIG. 15 is a rear elevational view of the clubhead.
Figure 16:
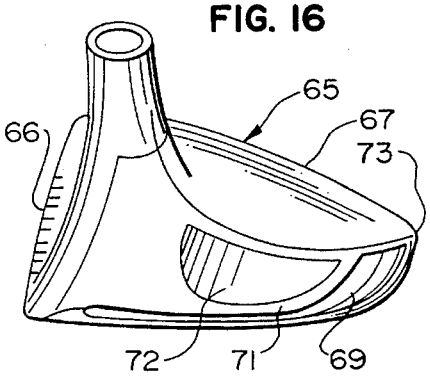
FIG. 16 is a heel end view of the clubhead.

Referring to FIG. 14, the toe and heel ends of the face in front of openings 71 and 72 are thicker than the portions of the face in front of the channels 74. Substantial weight is thereby positioned in the toe and heel areas.

The clubhead 65 can also be easily manufactured in one piece by investment casting, die casting, or similar techniques. Additional weight can be redistributed as desired by forming cutouts or openings in the bottom surface of the crown or in the rails.

Figure 22:
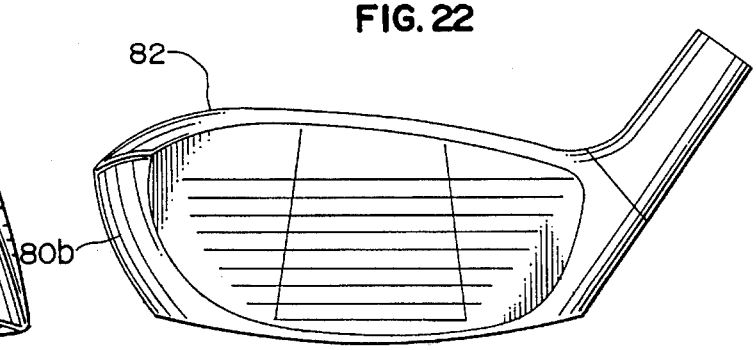
FIG. 22 is a front elevational view of the clubhead.
Figure 23:
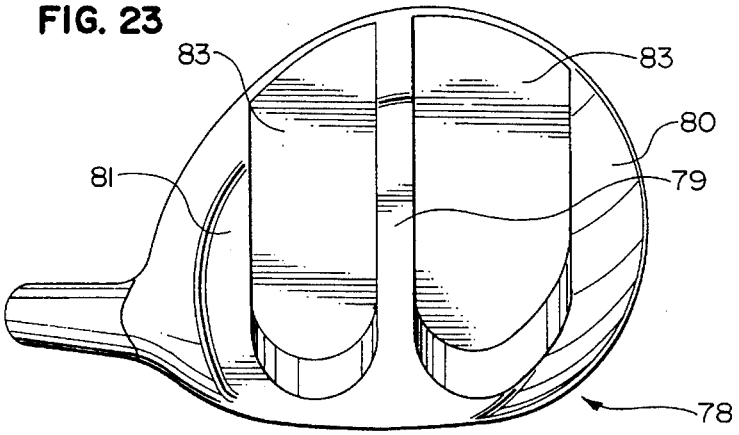
FIG. 23 is a bottom plan view of the clubhead.
Figure 24:
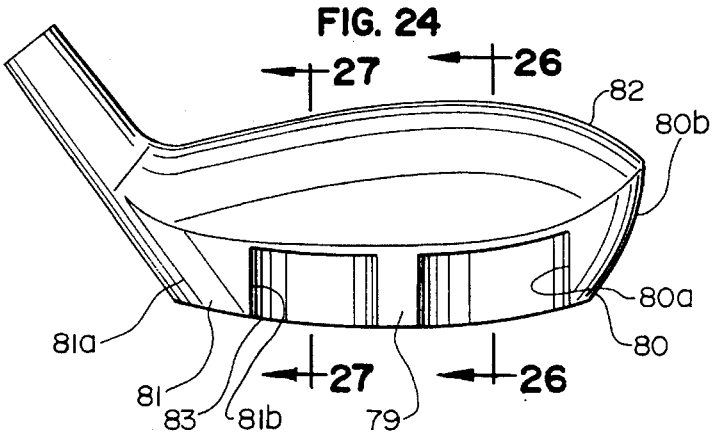
FIG. 24 is a rear elevational view of the clubhead.
Figure 25:
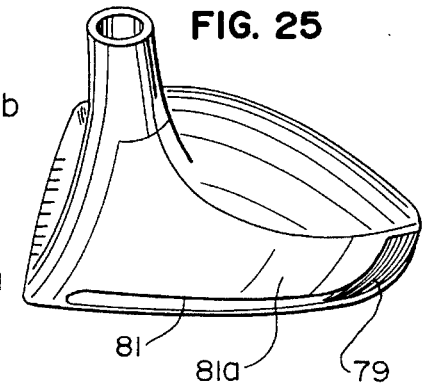
FIG. 25 is a heel end view of the clubhead.

FIGS. 19–27 illustrate a clubhead 78 with a relatively thin middle rail 79 and wider toe and heel rails 80 and 81. The toe rail 80 includes a flat inside surface 80*a* (FIG. 24) and a curved outer surface 80*b* which merges with the crown 82. The heel toe rail 81 includes a curved outer surface 81*a* which merges with the hosel and the crown and a flat inside surface 81*b*. The rails are separated by channels 83. The clubhead has a traditional appearance when viewed from above (FIG. 20) and toward the face (FIG. 22).

Figure 26:
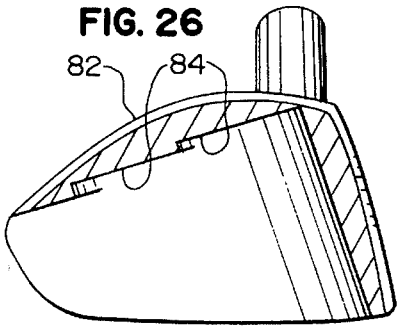
FIG. 26 is a sectional view taken along the line 26—26 of FIG. 24.
Figure 27:
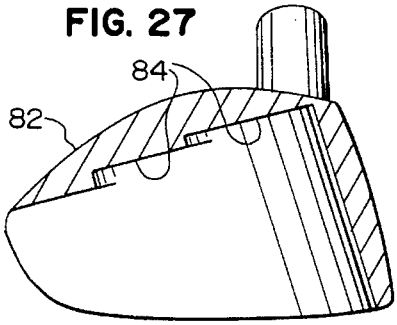
FIG. 27 is a sectional view taken along the line 27—27 of FIG. 24.
Figure 28:
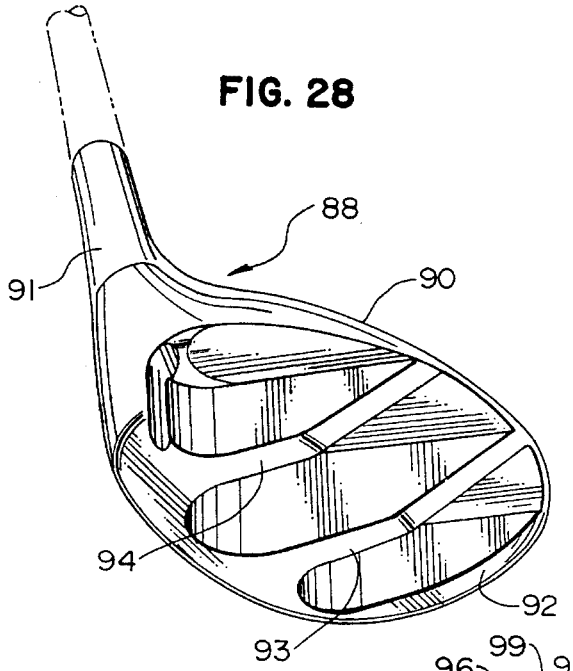
FIG. 28 is a bottom perspective view of a further embodiment of a clubhead.
Figure 29:
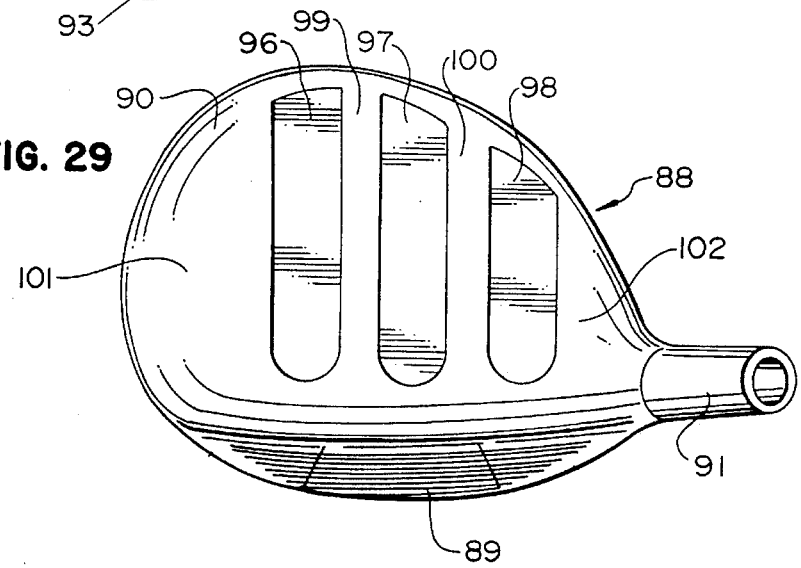
FIG. 29 is a top plan view of the clubhead.
Figure 30:
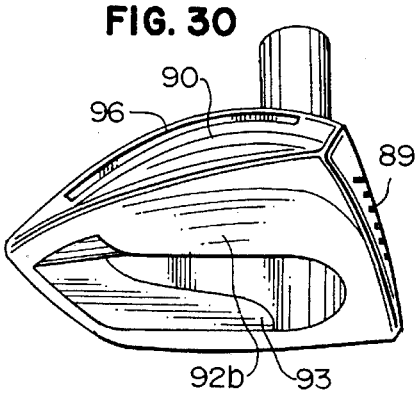
FIG. 30 is a toe end view of the clubhead.
Figure 31:
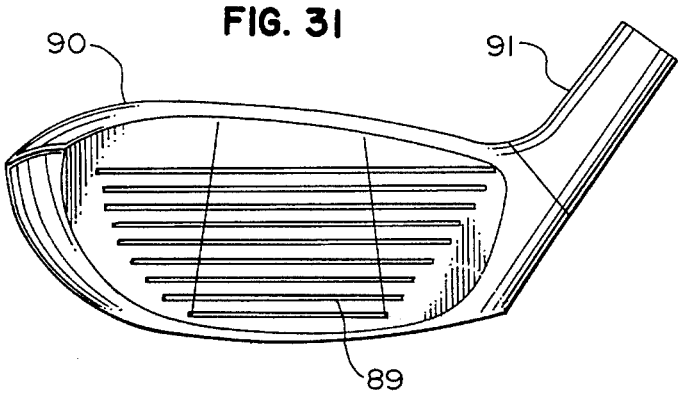
FIG. 31 is a front elevational view of the clubhead.
Figure 32:
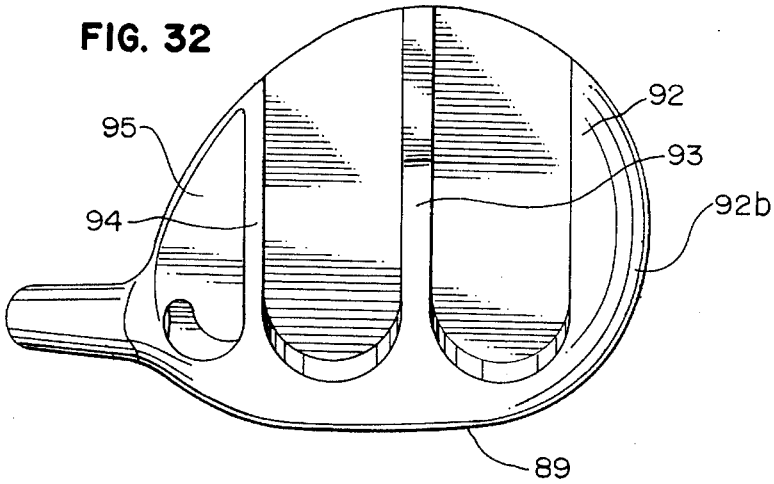
FIG. 32 is a bottom plan view of the clubhead.

Referring to FIGS. 26 and 27, weight may be removed from selected areas of the crown by forming cutouts or recesses 84. Additional weight can be redistributed by forming cutouts or recesses in the rails.

The face of the clubhead in the toe and heel areas is integral with the rails 80 and 81, and the effective thickness of the face extends to the back of the crown in those areas. The thickness of the face in front of the channels 83 is relatively thin.

The clubhead 88 in FIGS. 28–36 includes both top and bottom rails. The clubhead includes a face 89, a crown 90, and a hosel 91. In the embodiment illustrated, three bottom rails 92, 93, and 94 extend rearwardly from the face and downwardly from the crown. However, the bottom rails can be configured as in FIGS. 1–27 or in any other desired form. The toe rail 92 has a curved outer surface 92*b* which merges with the crown. The heel rail 94 is spaced inwardly from the heel of the clubhead to provide a heel opening 95.

Three recesses or channels 96, 97, and 98 are provided in the top surface of the crown to form a pair of substantially parallel rails 99 and 100. The channels and rails are generally parallel and extend generally perpendicularly to the face 89.

Figure 33:
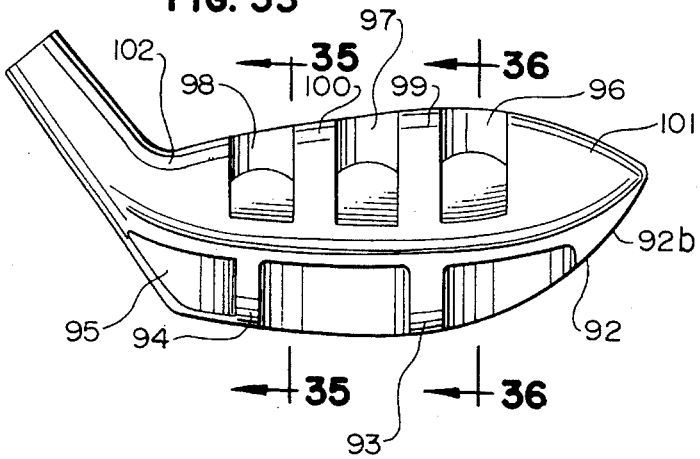
FIG. 33 is a rear elevational view of the clubhead.
Figure 34:
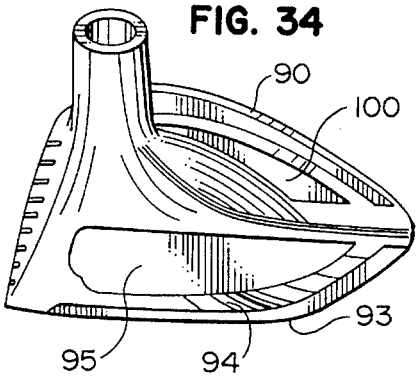
FIG. 34 is a heel end view of the clubhead.
Figure 35:
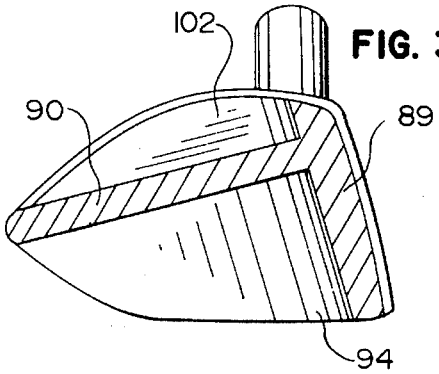
FIG. 35 is a sectional view taken along the line 35—35 of FIG. 33.
Figure 36:
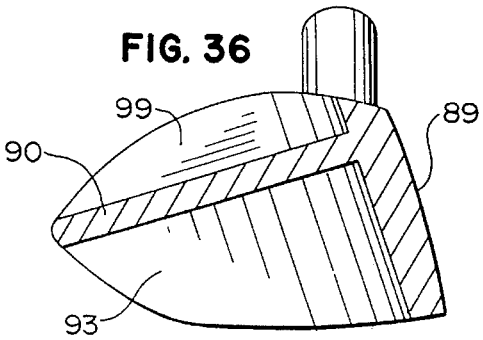
FIG. 36 is a sectional view taken along the line 36—36 of FIG. 33.

Referring to FIG. 33, the channels in the crown leave intact a toe portion 101 and a heel portion 102 on the crown. Some of the weight which is removed by the channels can be redistributed to the toe portion to obtain the benefits of high toe weighting. Some of the weight which is removed by the channels can be redistributed to the low heel portion of the face by making that portion of the face, i.e., the portion to the left of rail 94, thicker. Also, the effective thickness of the face in front of the toe rail 92 is greater than the thickness of the face between the rails.

Although the top recesses in the crown of the clubhead 88 are in the form of substantially parallel channels, other forms of recesses can be used. Also, more or less recesses can be used as desired.

Even though recesses are formed in the top of the crown, the recesses do not necessarily detract from the aesthetics of the club, particularly when the recesses are in the form of the parallel channels. If the channels extend perpendicularly to a tangent plane at the center of the face, the channels can be used as an alignment aid at address.

The clubhead 88 can also be formed in one piece by casting or the like. If desired, additional weight can be redistributed by forming cutouts in the crown or the rails.

While in the foregoing specification, a detailed description of a specific embodiment of the invention was set forth for the purpose of illustration, it will be understood that many of the details herein given may be varied considerably by those skilled in the art without departing from the spirit and scope of the invention.

We claim:

1. A golf clubhead comprising:

a front face having a toe portion, a heel portion, a bottom portion, and a top portion, a crown joined to the top portion of the face and extending rearwardly therefrom, a plurality of rails which are joined to the face and the crown and which extend rearwardly from the sole portion of the face and downwardly from the crown to provide a plurality of recesses behind the face and between the rails, the rails being constructed and arranged to permit weight of the clubhead to be positioned in the upper portion of the toe portion and the lower portion of the heel portion, the clubhead including a rear portion and a bottom portion, the recesses extending to the rear portion and to the bottom portion to provide openings in the rear portion and the bottom portion between the rails.

2. The clubhead of claim 1 including a toe wall joined to the toe portion of the face and to the crown.

3. The clubhead of claim 1 including a heel wall joined to the heel portion of the face and to the crown.

4. The clubhead of claim 1 in which the clubhead is formed integrally by casting.

5. The clubhead of claim 1 in which the clubhead is formed integrally by investing casting.

6. The clubhead of claim 1 in which the clubhead is formed integrally by die casting.

7. The clubhead of claim 1 in which the face is thicker in the toe portion of the face than in the middle of the face.

8. The clubhead of claim 1 in which the face is thicker in the heel portion of the face than in the middle of the face.

9. The clubhead of claim 1 in which one of the rails extends from the toe portion of the face and another of the rails extends from a portion of the face between the toe and heel portions, said one rail being thicker than said other rail.

10. The clubhead of claim 1 in which one of the rails extends from the heel portion of the face and another of the rails extends from a portion of the face between the toe and heel portions, said one rail being thicker than said other rail.

11. A golf clubhead comprising:

a front face having a toe portion, a heel portion, a bottom portion, and a top portion, a crown joined to the top portion of the face and extending rearwardly therefrom, a plurality of rails which are joined to the face and the crown and which extend rearwardly from the sole portion of the face and downwardly from the crown to provide a plurality of recesses behind the face and between the rails, the rails being constructed and arranged to permit weight of the clubhead to be positioned in the upper portion of the toe portion and the lower portion of the heel portion, the crown including top and bottom surfaces, the bottom surface being provided with a plurality of bores which do not extend to the top surface to remove weight from selected portions of the crown.

12. A golf clubhead comprising:

a front face having a toe portion, a heel portion, a bottom portion, and a top portion, a crown joined to the top portion of the face and extending rearwardly therefrom, a plurality of rails which are joined to the face and the crown and which extend rearwardly from the sole portion of the face and downwardly from the crown to provide a plurality of recesses behind the face and between the rails, the rails being constructed and arranged to permit weight of the clubhead to be positioned in the upper portion of the toe portion and the lower portion of the heel portions, at least one of the rails being provided with an opening to remove weight from a portion of said one rail.

13. A golf clubhead comprising:

a front face having a toe portion, a heel portion, a bottom portion, and a top portion, a crown joined to the top portion of the face and extending rearwardly therefrom, a plurality of rails which are joined to the face and the crown and which extend rearwardly from the sole portion of the face and downwardly from the crown to provide a plurality of recesses behind the face and between the rails, the rails being constructed and arranged to permit weight of the clubhead to be positioned in the upper portion of the toe portion and the lower portion of the heel portion, the crown including a top surface which is provided with a plurality of grooves which extend rearwardly from adjacent the face to remove weight from selected portions of the crown.

14. A golf clubhead comprising:

a front face having a toe portion, a heel portion, a bottom portion, and a top portion, a crown joined to the top portion of the face and extending rearwardly therefrom, a plurality of rails which are joined to the face and the crown and which extend rearwardly from the sole portion of the face and downwardly from the crown to provide a plurality of recesses behind the face and between the rails, the rails being constructed and arranged to permit weight of the clubhead to be positioned in the upper portion of the tow portion and the lower portion of the heel portion, the thickness of the face at one of the recesses being different than the thickness of the face at another of the recesses.

15. The clubhead of claim 14 in which the clubhead is provided with recesses in the toe portion, the heel portion, and in an intermediate portion between the toe and heel portions, the thickness of the face at the toe recess being greater than the thickness of the face at the intermediate recess.

16. The clubhead of claim 14 in which the clubhead is provided with recesses in the toe portion, the heel portion, and in an intermediate portion between the toe and heel portions, the thickness of the face at the heel recess being greater than the thickness of the face at the intermediate recess.

17. The clubhead of claim 14 in which the clubhead is provided with recesses in the toe portion, the heel portion, and in an intermediate portion between the toe and heel portions, the thickness of the face at the toe and heel recesses being greater than the thickness of the face at the intermediate recess.

* * * * *